US005578802A

United States Patent [19]

Palmowski

[11] Patent Number: 5,578,802

[45] Date of Patent: Nov. 26, 1996

[54] KEYPAD STRUCTURE INCLUDING SWITCHES WITH EXTERNAL METAL DOME LIKE SPRING OPERATING MEMBERS

[76] Inventor: David Palmowski, 3368 Pleasant Valley Rd., Syracuse, N.Y. 13215

[21] Appl. No.: 370,120

[22] Filed: Jan. 9, 1995

[51] Int. Cl.[6] ..... H01H 13/70

[52] U.S. Cl. ..... 200/5 A; 200/302.2

[58] Field of Search ..... 200/5 R, 5 A, 200/314, 512–517, 302.1–302.3, 317

[56] References Cited

U.S. PATENT DOCUMENTS

| | | | |
|---|---|---|---|
| 3,657,492 | 4/1972 | Arndt et al. | 200/5 R |
| 3,890,480 | 6/1975 | Berling et al. | 200/5 R X |
| 4,071,718 | 1/1978 | Harden | 200/5 A |
| 4,293,764 | 10/1981 | Amrhein | 200/314 X |
| 4,385,213 | 5/1983 | Larson | 200/5 A |
| 5,359,166 | 10/1994 | Elsaesser et al. | 200/5 A |
| 5,453,586 | 9/1995 | Sttotmann | 200/5 R |

*Primary Examiner*—J. R. Scott
*Attorney, Agent, or Firm*—Charles S. McGuire

[57] ABSTRACT

A keypad structure includes a printed circuit board with a plurality of miniature push-button switches mounted thereon in a predetermined array with the operating surfaces of the buttons substantially in a common plane. An array of holes is formed in a layer material termed a spacer member which is releasably secured to the pcb with the wall defining each hole surrounding a corresponding switch. A plurality of openings is formed in a template sheet which is adhesively secured to the spacer member. The openings in the template sheet are of larger diameter than the holes in the spacer member and provide a positioning guide for dome-type spring members which are supported on the spacer member and overlie the respective operating surfaces of the switch buttons. A flexible, outer sheet is adhesively secured to the outer surface of the template sheet, capturing the springs between the spacer member and the outer sheet. The switches are individually operable by manual pressure applied to selected areas of the outer sheet and repairs may be performed by detaching the pcb from the spacer member.

21 Claims, 5 Drawing Sheets

KEYPAD STRUCTURE INCLUDING SWITCHES WITH EXTERNAL METAL DOME LIKE SPRING OPERATING MEMBERS

BACKGROUND OF THE INVENTION

The present invention relates to improvements in the structure and method of assembly or fabrication of keypads, and more particularly to those types of multi-character devices electrically responsive to manual pressure applied to selected areas of a flexible sheet covering individual actuating members.

Keypads are used in many applications, normally in conjunction with other electrically operated devices or systems to provide inputs controlling operational parameters thereof. A number of basic types or structures of keypads are currently in widespread use. Some types, for example, are actuable by manual deformation of a layer of conductive rubber, or a metal spring member into contact with conductive portions of printed circuit boards.

Another popular type of keypad is actuated by manual pressure applied to selected areas of a continuous, flexible sheet, e.g., of Mylar or other suitable plastic, to which conductive ink has been applied by silk screening, or other such process. Such keypads are generally referred to as being of the membrane type and sometimes incorporate dome-type spring members to provide a more discernable feel or tactile response to a user when manual pressure is applied. Although membrane-type keypads may be fabricated at low cost by present-day manufacturing techniques, the cost of repairing or replacing individual defective components is so high in relation to the initial cost of the entire keypad that it is usual practise to discard a keypad upon malfunction of any portion thereof.

It is a principal object of the present invention to provide a keypad which has the look and feel of a conventional membrane-type device, but may be repaired at a cost far less than the replacement cost of the keypad.

Another object is to provide an economically repairable keypad having desirable tactile response characteristics.

A more general object is to provide improved keypad constructions and methods of fabrication of keypads.

Other objects will in part be obvious and will in part appear hereinafter.

SUMMARY OF THE INVENTION

A printed circuit board is prepared in the usual manner with conductive traces forming a desired circuit. A plurality of miniature switches each have a pair of leads extending from a body portion, through the printed circuit board and solder-connected in the circuit. The switches are thus mounted in a predetermined array with the switch bodies spaced from one another, extending outwardly from one surface of the printed circuit board. An operating button extends from each switch body and the operating surfaces of all buttons, i.e., the surfaces to which pressure is applied to operate the switch, are substantially in a common plane.

A spacer member is prepared by drilling a plurality of holes through a unitary, continuous layer of material in a positional relationship corresponding to that of the switches. The diameter of the holes is larger than the largest cross-dimension of the switch bodies, whereby the spacer member may be placed in face-to-face contact with the printed circuit board and each of the switch bodies will be surrounded by the wall defining one of the holes in the spacer member. The thickness of the spacer member is such that the surface thereof which faces away from the printed circuit board is at or near the plane of the operating surfaces of the switch buttons. The printed circuit board and spacer member are detachably secured to one another, e.g., by pins frictionally engaged in aligned opening.

A template sheet, preferably having pressure-sensitive adhesive on both sides, is prepared by cutting or punching a plurality of openings therein in an array corresponding to that of the holes in the spacer member. The openings in the template sheet have diameters larger than those of the holes in the spacer member. Thus, one surface of the template may be adhesively secured to the surface of the spacer member facing away from the printed circuit board with portions of the spacer member surface bordering the holes therein being exposed through the openings in the template sheet.

Spring members of a conventional type having a central, domed portion and peripheral support portion are placed upon the spacer member surfaces bordering the holes therein. Relative dimensions are such that the support portions of the spring members are closely surrounded by the openings in the template sheet, whereby the latter serves as a positioning aid or guide for the spring members. The domed portion of each spring member directly overlies the operating button of one of the switches, whereby manual pressure moving the domed portion to a flexed position serves to depress the switch button.

As a final step, an outer sheet of flexible material is placed over and adhesively secured to the outer surface of the template sheet. The outer sheet is continuous, i.e., it has no holes or openings corresponding to those of the spacer member and template sheet. Thus, the spring members are captured and held in position between the portions of the spacer member upon which the spring support portions rest and portions of the outer sheet. The outer sheet is printed with indicia corresponding to the function of the underlying switch which is actuated by manual pressure applied to the outer sheet. An appropriate flat cable or other electrical leads connect the keypad to a power supply, associated visual display, device or system receiving inputs from the keypad. Other electrical elements associated with keypad operation, e.g., a light-emitting diode (led), may be mounted upon the printed circuit board, surrounded by the walls of an opening in the spacer member, and visible through the outer sheet.

Virtually the only elements of the keypad subject to malfunction are the electrical connections, the switches, and other elements such as the aforementioned led, when included. The printed circuit board may be detached from the spacer member with all of the elements solder-connected to the printed circuit board remaining thereon, and the spring members remaining captured between the spacer member and the outer sheet. The defective component may then be removed and replaced, and the printed circuit board reattached to the spacer member, thereby effecting cheap and simple repair of the keypad.

The foregoing and other features of the structure and method of fabrication of the keypad of the present invention will be more readily understood and fully appreciated from the following detailed description, taken in conjunction with the accompanying drawings.

DETAILED DESCRIPTION

Figure 1:
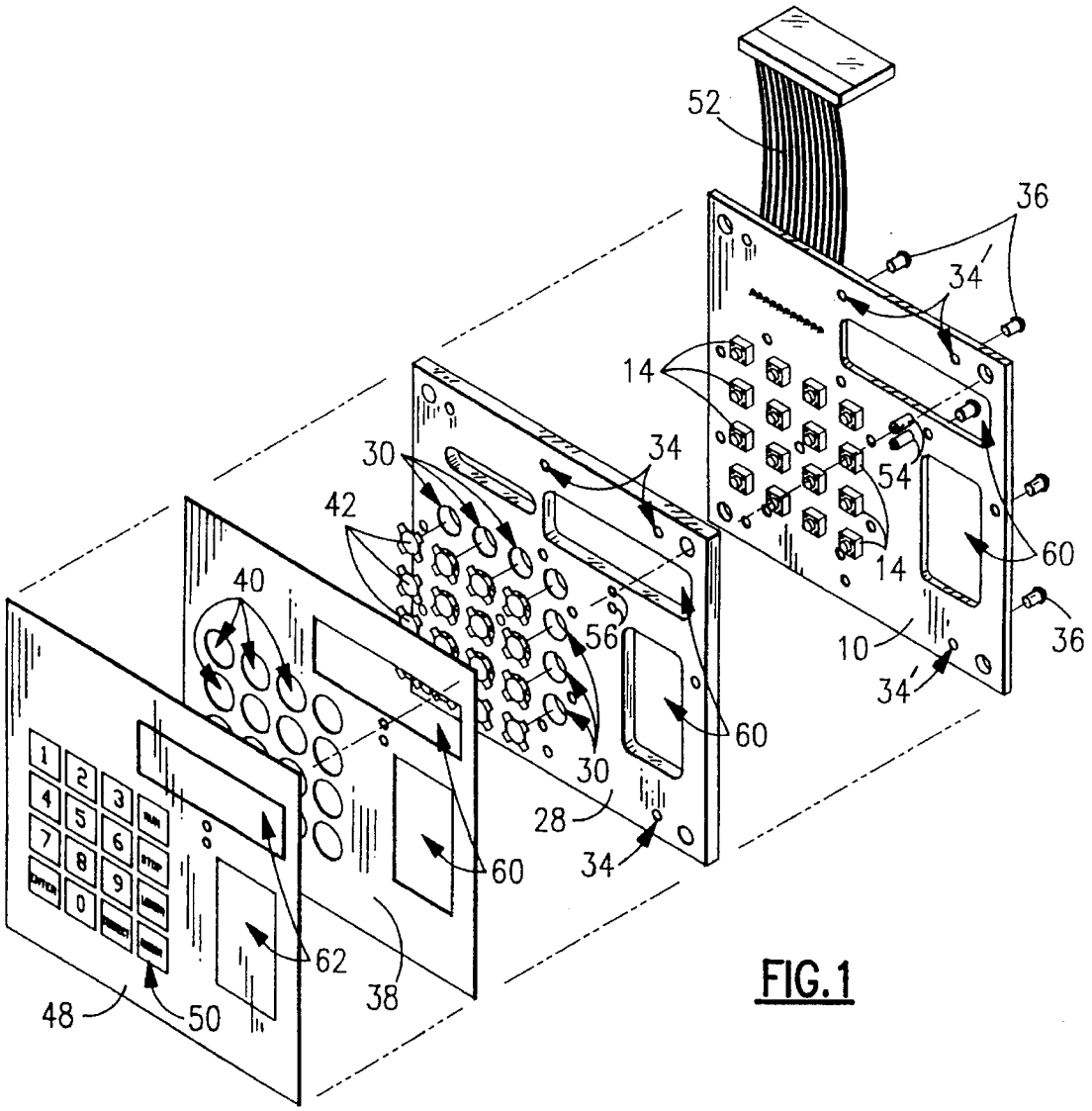
FIG. 1 is an exploded perspective of the elements of the keypad of the present invention.

Referring now to the drawings, printed circuit board 10 is prepared in the usual manner to carry on surface 12 thereof (FIGS. 5 and 6) an electrical circuit. Although the keypad could be constructed with a printed circuit board of the so-called surface mount type, the illustrated printed circuit board 10 is of the type wherein through openings are provided at the proper location for passage through the board of electrical leads or contacts of elements which are positioned one side of the board and connected to the circuit on the other side.

Figure 6:
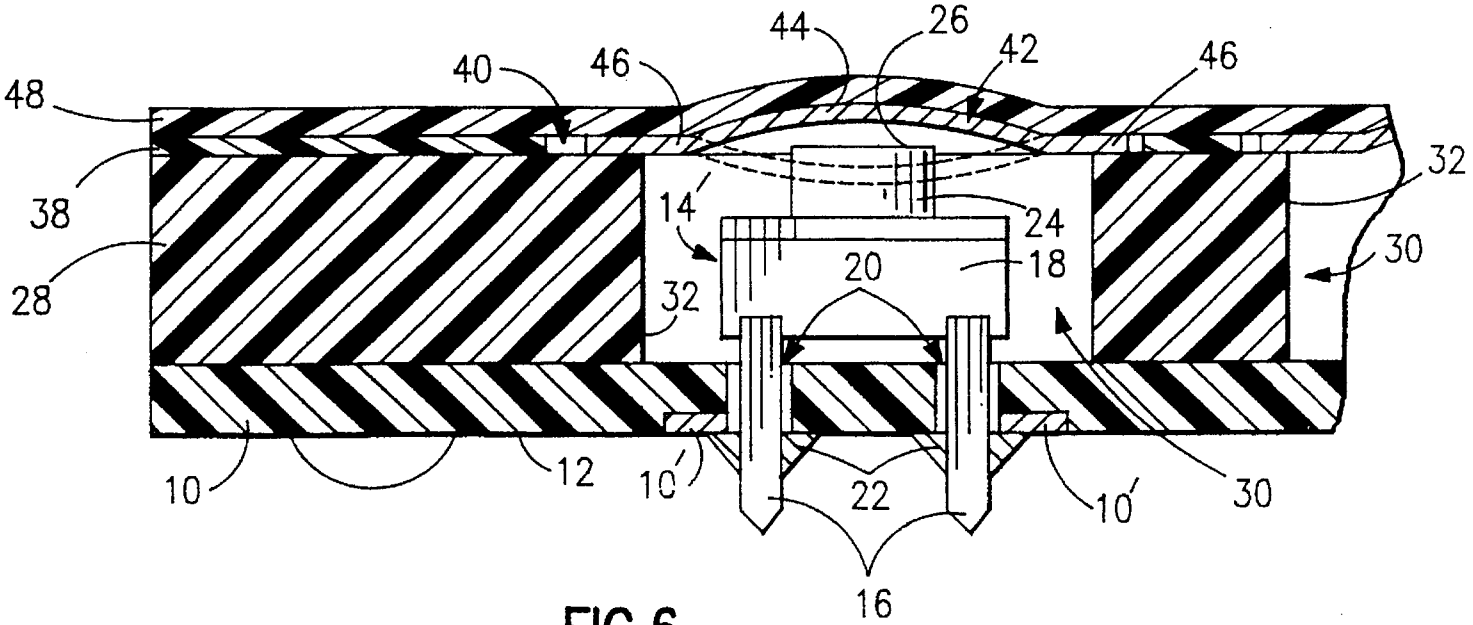
FIG. 6 is an enlarged fragment of the portion of FIG. 5 in the dotted-line circle denoted by numeral 6.

Following preparation of printed circuit board 10, the next step in the fabrication of the keypad is the mounting thereon of a plurality of switches 14. Each of switches 14 includes a pair of leads 16 extending from body portion 18 through openings 20 in printed circuit board 10, as indicated in FIG. 6 in connection with the switch denoted by reference numeral 14'. Leads 16 connect the associated switch into the circuit of printed circuit board 10 by solder connections 22. Button 24 is positioned on the opposite side of switch body 18 from leads 16 and is depressible, into the body portion, by pressure applied to operating surface 26 to effect actuation of the associated switch.

Switches 14 are of the momentary contact, push-button operated type, many versions of which, suitable for use in the keypad of the invention, are commercially available. Switches which would be considered of the miniature variety, would normally be the type used in keypads such as that of the present invention. In any event, the switches are mounted upon printed circuit board 10 to extend from the same side thereof in suitably spaced relation in a predetermined array or pattern. Moreover, switches 14 are so mounted that the operating surfaces 26 of all switches lie in a common plane.

Figure 2:
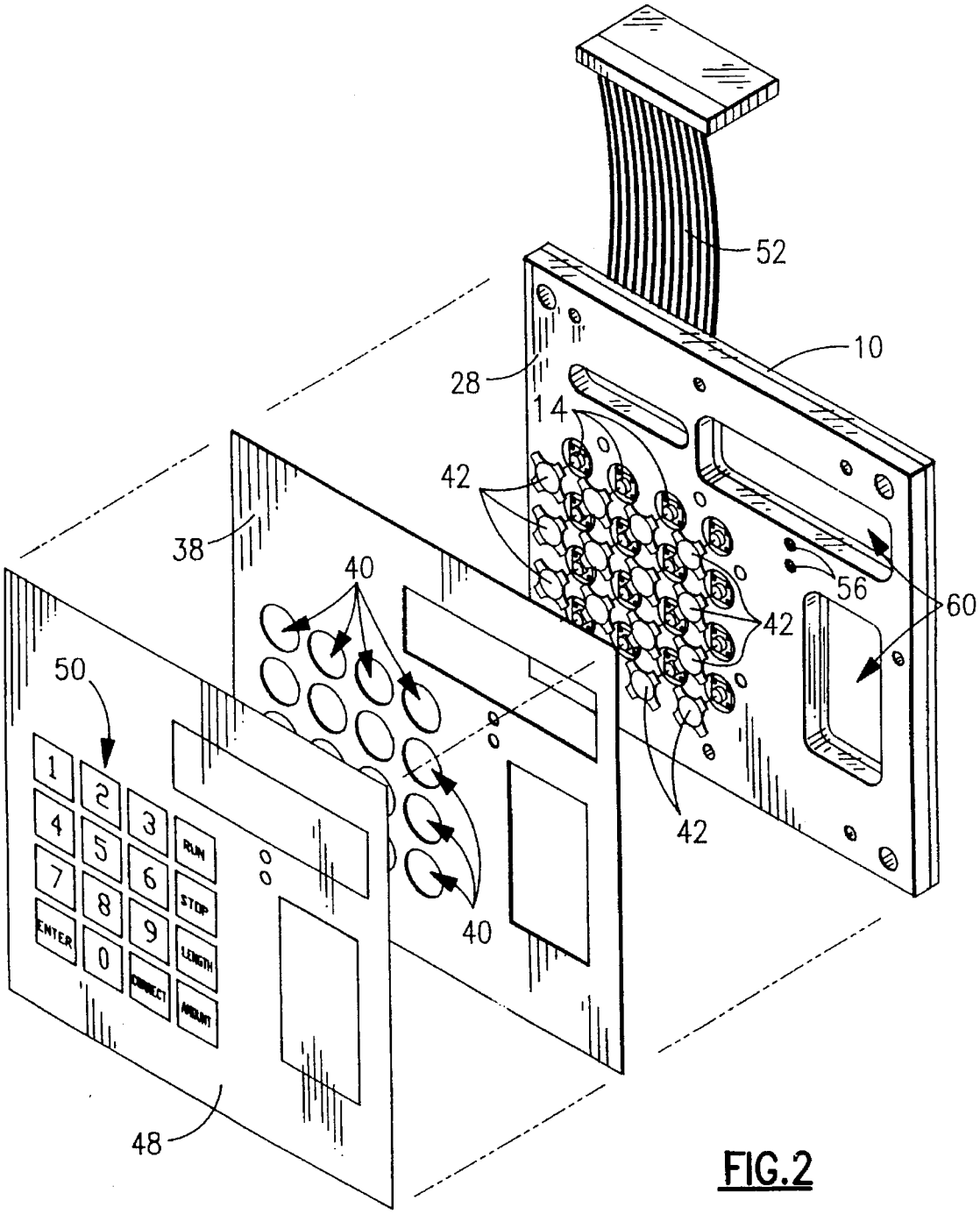
FIGS. 2 and 3 are perspective views, as in FIG. 1, with portions exploded, showing the progression of assembly of the various parts.

An element of the keypad termed a spacer member 28 is prepared for assembly with printed circuit board 10 by drilling or otherwise forming a plurality of holes 30 in an array corresponding to that in which switches 14 are mounted upon printed circuit board 10. The diameter of holes 30, which are defined by cylindrical walls 32 extending between opposite surfaces of spacer member 28, is greater than the largest cross dimension of switches 14, whereby each switch is surrounded by one of walls 32 when spacer member 28 is placed in face-to-face contact with printed circuit board 10, as shown in FIG. 2. Additional holes 34 in spacer member 28 are aligned with holes or openings 34' in printed circuit board 10 and the two elements are releasably connected by pins 36, or by screws or other fastening means, extending into the aligned openings.

Template sheet 38 is prepared by forming therein a plurality of openings or cut-out areas 40 in the same array as holes 30 and switches 14. Sheet 38 is preferably a double-sided adhesive sheet, i.e., it carries on each of its opposite surfaces, which may initially be covered in conventional fashion by layers of release paper (not shown), a pressure-sensitive adhesive. Template sheet 38 is placed in contact with, and thus adhesively secured to the surface of spacer member 30 facing away from printed circuit board 10. The diameter of openings 40 is larger than that of holes 30, whereby portions of the surface of spacer member 28 bordering holes 30 are exposed through and surrounded by openings 40.

Figure 3:
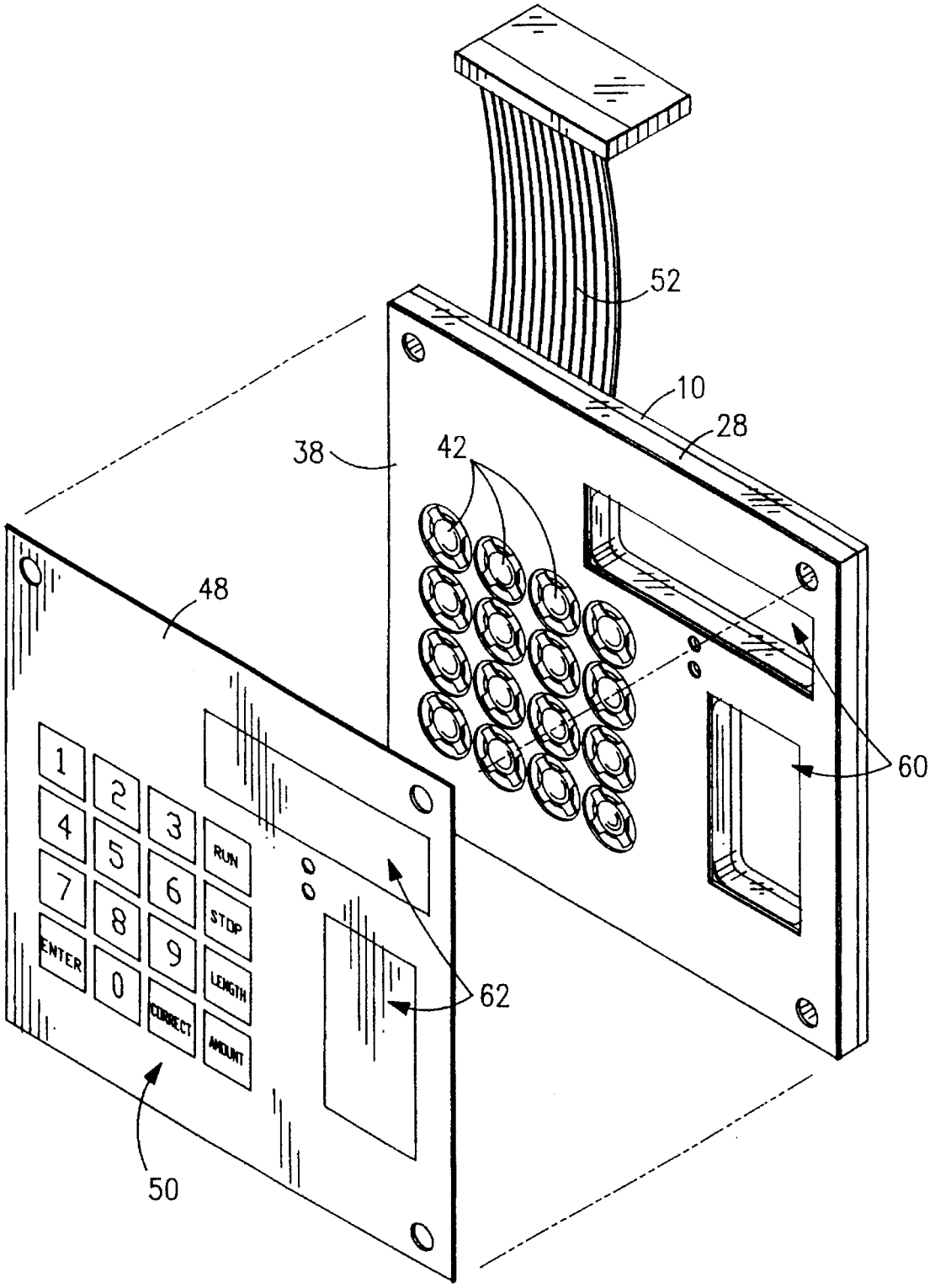

A plurality of spring members 42, corresponding in number to switches 14, each having a central, domed portion 44 and peripheral legs 42 may be placed with support portions 46 resting upon the surface portions of spacer member 28 bordering holes 30 and closely surrounded by openings 40 in template sheet 38, as shown in FIG. 3. The thickness of spring members 42 is preferably about the same as that of template sheet 38, whereby the edges of openings 40 provide a convenient positioning guide for spring members 42, ensuring that each of domed portions 44 directly overlies one of operating surfaces 26 of buttons 24.

Figure 4:
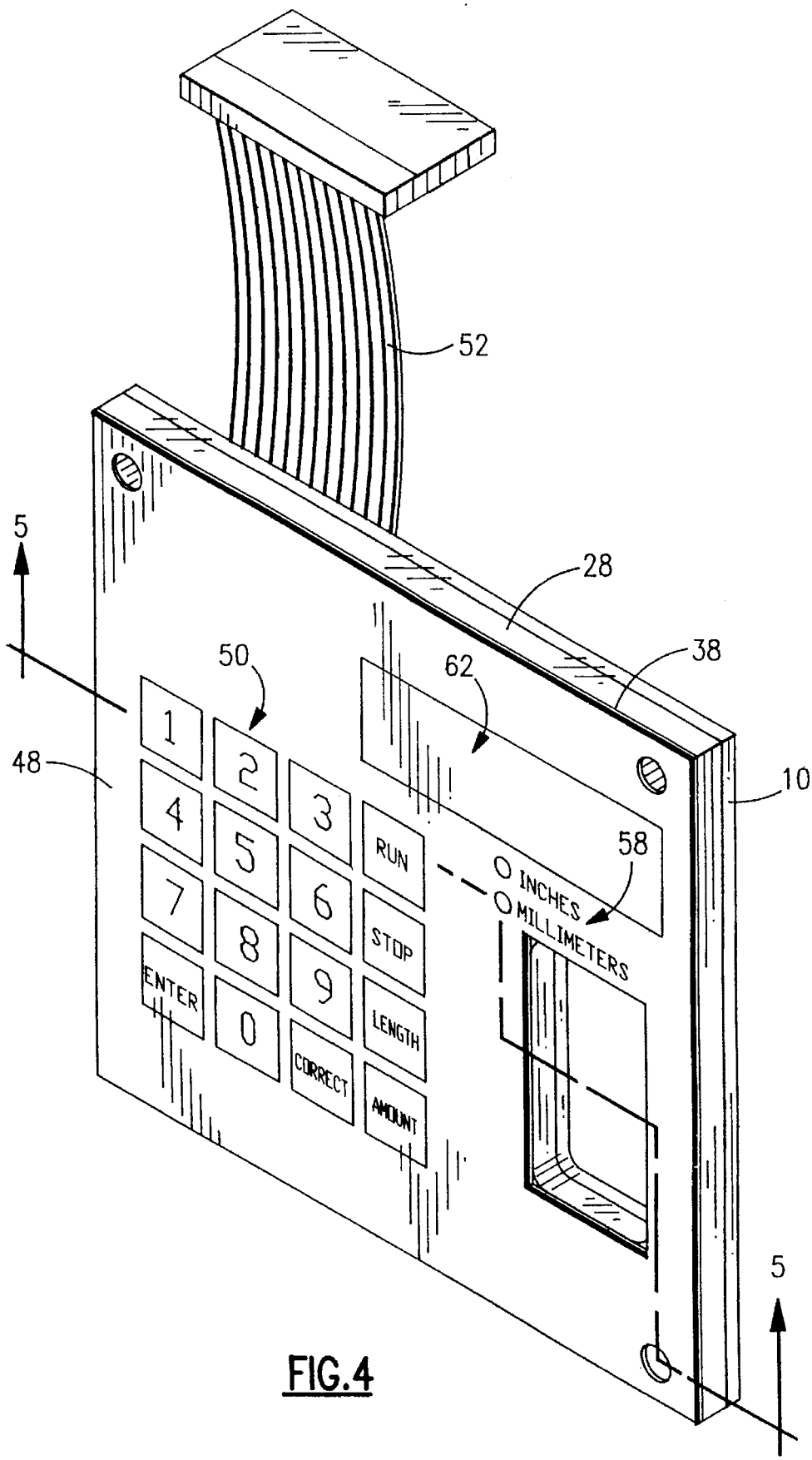
FIG. 4 is a perspective view of a fully assembled keypad.

As a final step in the fabrication of the keypad, outer sheet 48 is placed in covering relation and thereby adhesively secured to template sheet 38, as shown in FIG. 4. Outer sheet 48 is continuous, i.e., has no openings or cut-out portions in the areas where it overlies openings 40 and spring members 42, such areas bearing printed indicia, generally indicated by reference numeral 50, denoting the function or effect of actuation of the underlying switch. Thus, spring members 42 are captured between spacer member 28, upon which spring support portions 46 rest, and outer sheet 48, and surrounded by the edges of openings 40.

Figure 5:
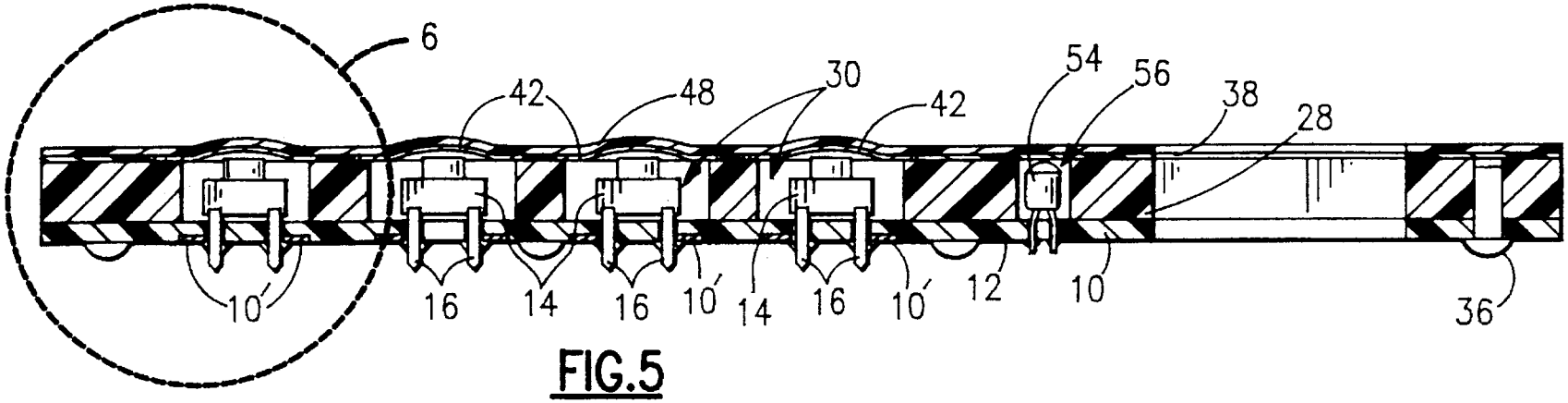
FIG. 5 is an elevational view in section on the line 5—5 of FIG. 4.

Manual pressure applied to an area of outer sheet 48 serves to flex sheet 48 inwardly, move domed portion 44 of the underlying spring member to a flexed position, indicated in dotted lines in FIG. 6, and depress button 24 to actuate the associated switch. In the illustrated embodiment, the circuit of printed circuit board 10 portions of which are seen in FIGS. 5 and 6 indicated by reference numeral 10' is connected by flat ribbon cable 52 to other electrical devices, systems, etc. which receive inputs corresponding to individual or sequential actuation of the keypad switches and operate in accordance with such inputs. Upon removal of manual pressure, button 24, spring member 42 and outer sheet 48, of course, return to their original positions, shown in solid lines in FIG. 6, wherein it will be noted that the plane of button operating surface 26, prior to depression of button 24, is at or near the plane of the surface of spacer member 28 facing away from printed circuit board 10.

A further useful feature is the option of incorporating in the keypad of the invention devices other than switches, e.g., light-emitting diodes (led's), lamps, or the like. In the illustrated embodiment, a pair of led's 54 each have leads extending through openings in printed circuit board 10 and connected in the circuit 10' on surface 12. A pair of holes 56 of appropriate size and position for surrounding led's 54, are formed in spacer member 28 as seen in FIG. 5. Indicia 58 (FIG. 4) is printed on outer sheet 48 in areas overlying led's 54 to provide a visual indication of an operating condition or parameter of equipment responsive to the keypad. Other openings, such as those indicated by reference numeral 60, may be provided through printed circuit board 10, spacer member 28 and template sheet 38 as desired to accommodate visual displays or other devices. Areas 62 of outer sheet 48 overlie openings 60 and may be contiguous portions of sheet 48 or may be openings therein, depending upon the purpose and intended use of these spaces which, in any case, form no part of the present invention. Also, openings or recesses may be provided in spacer member 28 to accommodate circuitry mounted on printed circuit board 10 with which the keypad circuitry interfaces.

From the foregoing it will be seen that the objects of the invention are realized in a keypad structure and method of fabrication which has the look and feel of a membrane-type switch, yet is repairable at an economically justified cost with access to any malfunctioning parts provided by separating the printed circuit board and the continuous spacer element. Moreover, the spacer and template sheet permit easy, fast and accurate placement of the spring members, and elements such as led's may be structurally and electrically incorporated directly into the keypad. It should also be noted that the spring members may not be required in applications wherein the switch operating buttons independently provide the desired tactile response. In other applications, where sealed, dustproof units are desired, the spacer member may be adhesively attached or cemented in face-to-face contact with the printed circuit board, although such constructions would be more difficult to repair.

What is claimed is:

1. A manually operated, multi-character keypad comprising:

a) a printed circuit board carrying at least one continuous circuit;

b) a plurality of miniature push-button switches each having a body portion carrying an outwardly biased button moveable inwardly by pressure applied to an operating surface for switch operation;

c) means connecting said switches in electrical communication with said circuit with said body portions extending from one side of said printed circuit board in a predetermined, spaced array;

d) a unitary, continuous, spacer member mounted to said one side of said printed circuit board and having a plurality of through, first openings each surrounding one of said switch body portions;

e) a flexible layer mounted in covering relation to said spacer member on the side opposite said printed circuit board, whereby manual pressure applied to portions of said flexible layer directly overlying said openings moves the underlying switch button inwardly to operate said switch; and f) a plurality of dome-type spring members each having a peripheral support portion and a central operating portion moveable by manual pressure from an unbiased position to a biased position and returning to said unbiased position upon removal of said pressure, and means for mounting said spring members with respect to said spacer member and said buttons for transfer of movement of said spring operating portion from said unbiased to said biased position to cause inward movement of said buttons.

2. The keypad of claim 1 wherein said spacer comprises a rigid layer of material having first and second, planar surfaces respectively facing toward and away from said printed circuit board, and said button operating surfaces are in a common plane at or near the plane of said second surface.

3. The keypad of claim 2 wherein said rigid layer is detachably affixed directly to said printed circuit board in face-to-face contact.

4. The keypad of claim 1 wherein said mounting means comprise portions of said spacer member bordering said first openings upon which said support portions of said spring members are supported.

5. The keypad of claim 4 and further comprising a template sheet having a plurality of second openings arranged in said predetermined array, said template sheet being mounted between said spacer member and said flexible layer with said second openings surrounding said portions of said spacer member bordering said first openings.

6. The keypad of claim 5 wherein said template sheet is adhesively secured on one surface thereof to an opposing surface of said spacer member and is adhesively secured on its opposite surface to an opposing surface of said flexible layer.

7. The keypad of claim 1 wherein said connecting means comprises electrical leads extending from each of said switch body portions through said printed circuit board for connection in said circuit on the other side of said printed circuit board.

8. The keypad of claim 7 wherein said leads are solder-connected to said circuit, whereby said switches are substantially rigidly supported with respect to said printed circuit board, and said first openings are defined by walls which are spaced from said switch body portions.

9. The keypad of claim 8 wherein said spacer member comprises a sheet of material having a thickness substantially at least as great as the combined height of said switch body portions and buttons.

10. The keypad of claim 1 and further including at least one electrical illuminating device connected in said circuit extending from said one side of said printed circuit board and surrounded by the wall of an opening through said spacer member.

11. The keypad of claim 10 wherein said illuminating device is a light emitting diode.

12. A manually operated, multi-character keypad comprising:

a) a printed circuit board carrying at least one continuous circuit;

b) a plurality of miniature push-button switches each having a body portion carrying an outwardly biased button moveable inwardly by pressure applied to an operating surface for switch operation;

c) means connecting said switches in electrical communication with said circuit with said body portions extending from one side of said printed circuit board in a predetermined, spaced array;

d) a unitary, continuous, spacer member comprising a sheet of material having a thickness substantially at least as great as the height of said switch body portions and buttons mounted to said one side of said printed circuit board and having a plurality of through, first openings each surrounding one of said switch body portions; and e) a flexible layer mounted in covering relation to said spacer member on the side opposite said printed circuit board, whereby manual pressure applied to portions of said flexible layer directly overlying said openings moves the underlying switch button inwardly to operate said switch.

13. The keypad of claim 12 wherein said spacer comprises a rigid layer of material having first and second, planar surfaces respectively facing toward and away from said printed circuit board, and said button operating surfaces are in a common plane at or near the plane of said second surface.

14. The keypad of claim 13 wherein said rigid layer is detachably affixed directly to said printed circuit board in face-to-face contact.

15. The keypad of claim 12 and further including a plurality of dome-type spring members each having a peripheral support portion and a central operating portion moveable by manual pressure from an unbiased position to a biased position and returning to said unbiased position upon removal of said pressure, and means for mounting said spring members with respect to said spacer member and said buttons for transfer of movement of said spring operating portion from said unbiased to said biased position to inward movement of said buttons.

16. The keypad of claim 15 wherein said mounting means comprise portions of said spacer member bordering said first openings upon which said support portions of said spring members are supported.

17. The keypad of claim 16 and further comprising a template sheet having a plurality of second openings arranged in said predetermined array, said template sheet being mounted between said spacer member and said flexible layer with said second openings surrounding said portions of said spacer member bordering said first openings.

18. The keypad of claim 17 wherein said template sheet is adhesively secured on one surface thereof to an opposing surface of said spacer member and is adhesively secured on its opposite surface to an opposing surface of said flexible layer.

19. The keypad of claim 12 wherein said connecting means comprises electrical leads extending from each of said switch body portions through said printed circuit board for connection in said circuit on the other side of said printed circuit board.

20. The keypad of claim 19 wherein said leads are solder-connected to said circuit, whereby said switches are substantially rigidly supported with respect to said printed circuit board, and said first openings are defined by walls which are spaced from said switch body portions.

21. The keypad of claim 12 and further including at least one electrical illuminating device connected in said circuit extending from said one side of said printed circuit board and surrounded by the wall of an opening through said spacer member.

* * * * *